United States Patent [19]

Heymann

[11] 4,185,226

[45] Jan. 22, 1980

[54] SPRAY GUN FOR A DIRECT-VISION IMAGE STORAGE TUBE AND AN IMAGE-STORAGE TUBE USING THIS GUN

[75] Inventor: Roger Heymann, Paris, France

[73] Assignee: Thomson-CSF, Paris, France

[21] Appl. No.: 889,281

[22] Filed: Mar. 23, 1978

[30] Foreign Application Priority Data

Mar. 29, 1977 [FR] France ..... 77 09293

[51] Int. Cl.[2] ..... H01J 29/50; H01J 31/18

[52] U.S. Cl. ..... 315/13 ST; 313/396; 313/432

[58] Field of Search ..... 313/396, 398, 439, 432; 315/13 ST, 17

[56] References Cited

U.S. PATENT DOCUMENTS

| | | | |
|---|---|---|---|
| 3,278,781 | 10/1966 | Burns | 313/396 |
| 3,496,406 | 2/1970 | Deschamps | 313/429 X |
| 3,772,553 | 11/1973 | Balint et al. | 313/439 |
| 3,792,303 | 2/1974 | Albertin et al. | 313/429 X |
| 4,130,775 | 12/1978 | Perkins et al. | 313/397 |

*Primary Examiner*—Robert Segal

*Attorney, Agent, or Firm*—Roland Plottel

[57] ABSTRACT

A quadripolar lens incorporated in the spray gun of direct vision image storage tubes enables the density of electrons in the spray beam to be controlled, over a wide range, by acting on the potential of the control grid of the gun, without varying the acceleration potentials.

3 Claims, 3 Drawing Figures

SPRAY GUN FOR A DIRECT-VISION IMAGE STORAGE TUBE AND AN IMAGE-STORAGE TUBE USING THIS GUN

This invention relates to a spray gun for direct-vision image-storage tubes and to the tubes comprising a gun of this type.

Tubes of the type in question comprise, in a vacuum compartment, four principal elements which are: a memory surface, an electron gun or an assembly of electron guns of the so-called recording type, an electron gun or an assembly of electron guns of the so-called spray type or storage type and a luminescent screen on which the information recorded on the memory surface by the electrons of the recording guns is viewed.

The memory surface comprises an electrically conductive support, for example in the form of a grid, which is covered with an insulating material on that surface which faces the recording assembly. It is placed opposite the screen with its other surface facing towards the screen. In operation, it is scanned point-by-point by the beam coming from the recording assembly which comprises the focussing and deflecting means required for this purpose. The recording electrons have a velocity sufficient to cause the emission of secondary electrons by the insulating material with a coefficient $\delta$ of greater than one (more emitted electrons than incident electrons) and, hence, the appearance of positive charges on the insulating material. A collector which intercepts the secondary electrons emitted is associated with the memory grid in question. The quantity of positive charges appearing at each point of the insulating material is dependent upon the signal carried by the recording beam during its impact at that point, so that the information to be displayed is recorded on the memory grid at the point in question. The spray assembly permanently delivers a slow uniform beam covering the entire surface of the grid, the electrons of this slow beam passing through the grid without effacing the positive charges which are recorded thereon. These electrons are then highly accelerated between the memory grid and the screen by the very high voltage applied to the screen on which they produce a visible trace of the signal recorded at each point of the memory grid by the recording guns. Accordingly, it is possible to observe the phenomena recorded on the memory grid for a certain period which is of the order of a few seconds, a few minutes and sometimes longer.

However, it is limited by the formation of positive ions in the tube following the bombardment of the residual gas atoms contained in the envelope by the spray electrons in that zone of the tube where they are highly accelerated, i.e. between the memory grid and the screen, as already mentioned. These positive ions, which are deposited on the memory grid, ultimately obliterate the signal which is recorded thereon. This period of time is shorter, the higher the density of these ions in the envelope. All things being equal, the density of these ions is itself proportional to the density of the electrons in the spray beam. Accordingly, in order to vary the observation time, it is necessary to vary the density of the spray beam. By reducing the density of the spray beam, it is possible, in accordance with the foregoing, to increase the observation or memory time of the tube.

Storage guns known from the prior art make no effective provision for the control of this density. In general, they comprise in front of the cathode a control grid of which the potential in relation to the cathode controls the opening of the spray beam. Any increase in the absolute value of the negative polarisation of the control grid reduces the opening of the beam without significantly affecting its density.

On the other hand, variations in the positive voltage of the accelerating electrode or anode situated beyond the control grid in these guns enable the density in question to be varied, but only within narrow limits.

In short, therefore, prior art tubes are characterised by the appearance of a marked diaphragm effect in the spray beam when the absolute value of the negative potential of the control grid in question is increased without, however, affording the possibility of significantly reducing the density of the electrons in the beam or of increasing the memory time by corelative variation of the voltages of the acceleration electrodes.

It is for this reason that it was proposed in the prior art, with a view to increasing the memory time, to modulate or trim the spray beam so as to reduce the number of ions formed in the tube per unit of time for the same density of the spray beam. The remanence of the screens afforded a certain latitude in the choice of the characteristics of these trimmings or modulations without the luminous image being in any danger of flickering on the viewing screen. However, it was found that the application to the electrodes of the spray gun of the signals required for these modulations or trimmings, for example alternating signals, considerably modifies the trajectories of the electrons of the recording beam in this type of tube where, for reasons of compactness, the guns are all situated very close to one another. Due to this proximity, the change in the operating conditions of the storage guns modifies the optics of the recording guns to an extent which is incompatible with a high quality of the images.

The present invention relates to a spray gun structure for image storage tubes which obviates these difficulties.

By virtue of the gun according to the invention, it is possible to control the spray beam without any of the restrictions previously encountered and, in particular, to control its density over a wider range without significantly varying its opening, i.e. without the diaphragm effect previously encountered, as will be seen hereinafter with reference to a numerical example taken from tests conducted by applicants.

To this end, a quadripolar lens is incorporated in the spray guns according to the invention under conditions which will be specified hereinafter.

The invention will be better understood from the following description in conjunction with the accompanying drawings, wherein.

Figure 1:
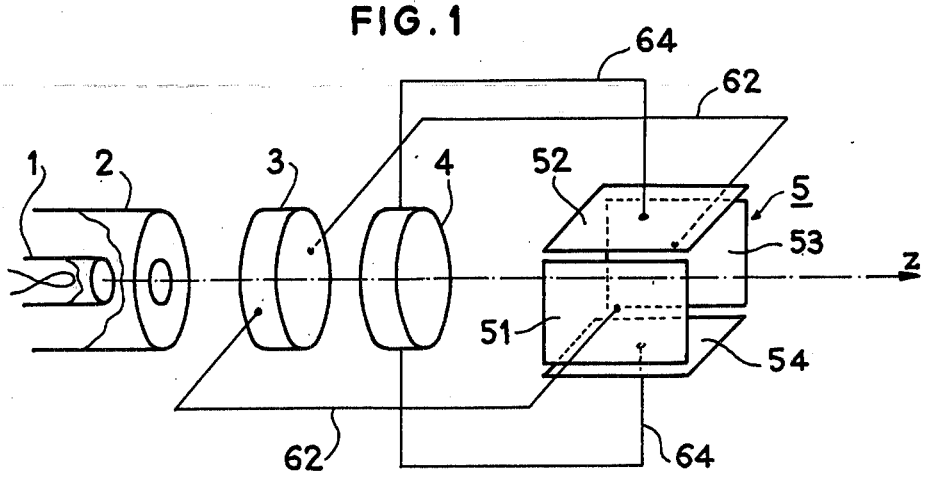
FIG. 1 is a perspective view of one example of a spray gun structure according to the invention for direct-vision image-storage tubes.

FIG. 1 diagrammatically illustrates one example of a spray gun according to the invention.

In FIG. 1, the reference 1 denotes the cathode of the gun with its heating filament (unidentified in the drawing), whilst the reference 2 denotes the control electrode which is normally associated with it and which is diagrammatically illustrated in the form of a cylinder drilled with a hole. The references 3 and 4 denote two cylindrical electrodes for accelerating the beam of electrons issuing from the cathode 1.

With the cathode at zero reference potential, the electrodes 2, 3 and 4 are brought in operation, by sources which have not been shown since they are not specific to the invention, to potentials of from −15 volts to zero volts in the case of the first electrode and from about +40 volts to +150 volts, respectively, for the last two electrodes.

In the spray guns according to the invention, a quadripolar lens 5 is arranged behind the electrode 4 in the path of the beam of electrons (not shown in the Figure) which is accelerated beyond the lens in question towards the right in the Figure to the memory surface and the display screen under conditions known in the art of image storage tubes. In the Figure z denotes the axis of the tube along which the electrons of the spray beam progress.

As known in the art, a quadripolar lens consists of a first pair of electrodes arranged opposite one another and of a second pair of electrodes which are also arranged opposite one another and which are roughly oriented perpendicularly of the first pair of electrodes. By bringing each of these pairs of electrodes to a given potential relative to the preceding acceleration electrodes, the electrons of a beam following the axis z on entering the lens are made to converge in the direction perpendicular to one of the pairs of plates and to diverge in the direction perpendicular to the other pair.

More precisely and assuming that there is only one accelerating electrode, it is possible by bringing one of these pairs to a negative potential −V and the other pair to a positive potential +V in relation to the accelerating electrode in question, to cause the electrons of the beam to diverge in the direction perpendicular to the pair of electrodes brought to the potential +V and to converge in the direction perpendicular to the other pair of electrodes.

Figure 2:
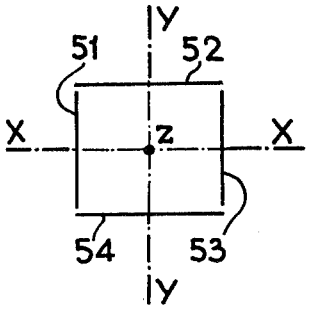
FIG. 2 is a section through one of the elements of the gun shown in FIG. 1.

In the example illustrated, these electrodes are formed for example by flat plates 51, 52, 53 and 54 occupying four of the faces of a parallelepiped, as shown in FIG. 1 and in FIG. 2 which is a section through the lens at its centre along a plane perpendicular to the axis z of the tube. In addition, in the example shown in FIG. 1 where accelerating electrodes 3 and 4 at different potentials are used, one of these pairs of plates is connected to one of the accelerating electrodes and the other to the second accelerating electrode, as shown in the drawing: the plates 51 and 53 to the electrode 3 by the connections 62 and the plates 52 and 54 to the electrode 4 by the connections 64. Under these conditions and in accordance with the foregoing observations, the quadripolar lens 5 causes the beam of electrons to converge in the direction XX perpendicular to the plates 51 and 53 (see FIG. 2) and to diverge in the direction YY.

Experience has shown that this arrangement enables the density of the electrons in the spray beam to be varied within very wide limits simply by acting on the potential of the control grid 2 (FIG. 1) of the spray gun for a fixed potential of the accelerating electrodes 3 and 4. The variations in density may be indirectly reflected in variations in the memory times of the tube when this potential is varied.

With the values of the potentials quoted above for the two electrodes 3 and 4, namely +40 volts and +150 volts, respectively, relative to the cathode, it can be seen that, when the voltage of the control grid 2 varies from zero to −15 volts, the memory time passes from 20 to 400 seconds. No diaphragm effect is observed between these two extreme values. In every case, the image covers the entire display screen. In the tests, the voltage of the display screen was 7 kV. The metallic support of the memory grid was at zero potential.

It will be noted that, by virtue of the spray guns according to the invention, it is reciprocally possible to reduce the recording time of the image storage tubes for a fixed memory time because the reduction in ionisation in the tube enables the quantity of charges necessary for recording to be proportionally reduced. Thicker memory grids of lower capacity will be used for this purpose.

Finally, it is obvious that, all other things being equal, the brilliance of the image formed on the luminescent screen will vary with the polarisation of the control electrode in the same way as in the density of the spray beam. Accordingly, the brilliance of the image in the tubes according to the invention will thus be controlled by the potential of the control grid of their spray gun.

Figure 3:
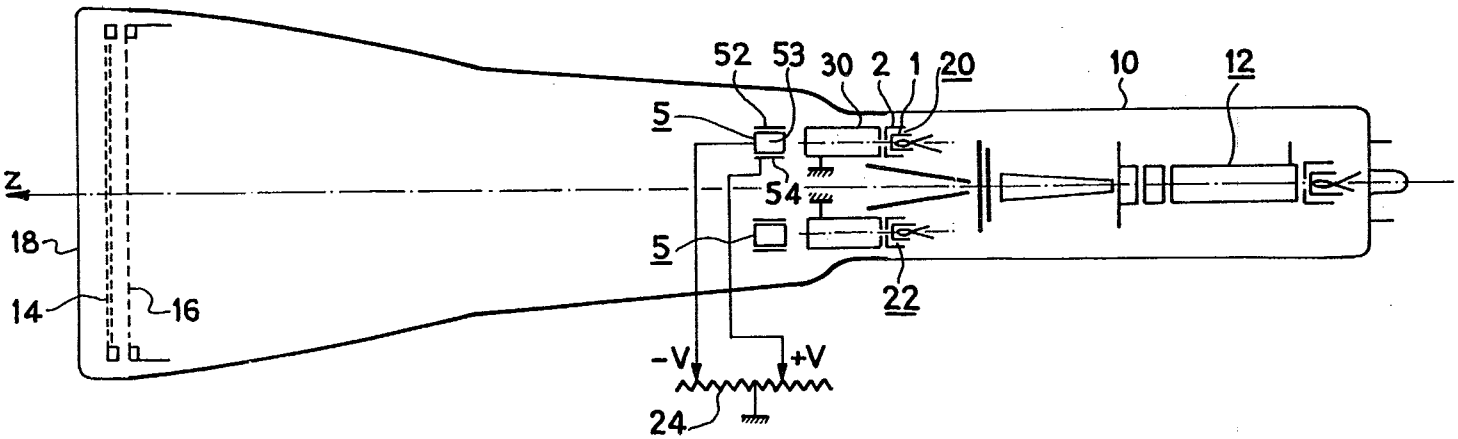
FIG. 3 is a section through an image storage tube equipped with a gun according to the invention.

A tube of this type is shown diagrammatically in section in FIG. 3 in which the same elements as in FIG. 1 are denoted by the same references. The example illustrated is that of a tube having a single, central recording gun, of which the axis coincides with that of the tube, and two storage guns arranged symmetrically on either side of the recording gun. In FIG. 3, the reference 12 denotes the recording gun and the references 20 and 22 the two spray guns each comprising a quadripolar lens 5. In the example, each of these guns comprises a single accelerating electrode 30 connected to earth, the cathode and the control grid being at negative potentials. As shown in FIG. 3, the pairs of electrodes of the quadripolar lens 5 are connected to the points at the potentials +V and −V of the potentiometer 24. None of the other connections of the electrodes of the tube nor the potential sources have been shown in FIG. 3. The reference 10 denotes the vacuum envelope of the tube, the references 14 and 16 respectively denote the memory grid and the secondary-electron collector associated therewith and the reference 18 denotes the luminescent screen which forms an integral part of the envelope.

Tubes of the type in question are used in laboratories for observing signals of very short duration, particularly in high-speed electronics, and in the heavy-current field for observing ruptures, etc.

Of course, the invention is not limited to the embodiments described and shown, which were given solely by way of example.

What is claimed, is:

1. An adjustable memory-time direct vision image storage tube comprising in an evacuated envelope a record gun, a spray gun, a memory surface, and a luminescent output screen, the duration of the memory of said tube being adjusted by including means for providing a d.c. potential on a control grid of said spray gun, said spray gun comprising cathode means for producing a beam of electrons; said control grid being associated with said cathode for controlling the density of the said electron beam in accordance with the d.c. potential; accelerating electrode means for accelerating said beam of electrons and including means for accelerating said beam of electrons and including means for receiving potential which is constant; quadraopolar lens means positioned about the path of the accelerated beam, and formed by two pairs of flat plate electrodes occupying four of the faces of a parallelepiped, with the electrodes of a pair being opposite one another, and the electrodes of the pairs being perpendicular to one another about the beam; means for applying a greater potential to one of said pairs of electrodes than to the other of said pairs of electrodes, for causing said beam to form a spray shape beam; said means for providing the adjusted potential on said control grid thus controlling the density of the electrons in the spray beam, and an image's duration on said tube being proportional to said beam density.

2. A tube according to claim 1 wherein said accelerating means includes two grids and said means for applying includes electrical connection between said two grids and said two pairs of electrodes.

3. A tube according to claim 1 or 2 wherein with said cathode a ground said control grid has a potential between ground and −15 volts and one of said pair of electrodes is at +40 volts and the other is at +150 volts.

* * * * *